United States Patent [19]

Campbell

[11] 4,357,008

[45] Nov. 2, 1982

[54] CREEL ASSEMBLY

[75] Inventor: Roscoe Campbell, Dayton, Ohio

[73] Assignee: Harris Corporation, Dayton, Ohio

[21] Appl. No.: 174,485

[22] Filed: Aug. 1, 1980

[51] Int. Cl.[3] ..... B65H 29/40

[52] U.S. Cl. ..... 271/315; 271/187

[58] Field of Search ..... 271/315, 187, 178, 82, 271/81, 83, 66, 70, 72, 277; 198/653, 480; 414/81; 101/240

[56] References Cited

U.S. PATENT DOCUMENTS

| | | | |
|---|---|---|---|
| 651,382 | 6/1900 | Pettee | 271/178 X |
| 1,756,616 | 4/1930 | Wood | 271/83 X |
| 4,211,320 | 7/1980 | Yautz et al. | 271/187 X |

*Primary Examiner*—Bruce H. Stoner, Jr.

*Attorney, Agent, or Firm*—Biebel, French & Nauman

[57] ABSTRACT

A creel assembly for use in a business forms delivery apparatus wherein individual business forms are received between adjacent spirally formed fingers of a plurality of aligned creel assemblies for the purpose of inverting the business forms from a "face up" to a "face down" position. An individual creel assembly is provided in which a pair of finger support plates are secured together with equal numbers of fingers being mounted to each support plate and which fingers can be brought into registry with one another or positioned at intermediate locations between the fingers on another plate so that twice as many fingers are available for receiving business forms than when the fingers are positioned in registry with one another.

4 Claims, 5 Drawing Figures

CREEL ASSEMBLY

BACKGROUND OF THE INVENTION

1. Field of the Invention

The present invention relates to business forms delivery apparatus, and more particularly, to a creel assembly for inverting business forms from a "face up" to a "face down" position for subsequent processing.

2. Prior Art

The present invention was designed particularly for use in a delivery apparatus to be associated with a business forms printing press or collating unit, although it is to be understood that the device is readily utilizable in many other environments and is therefore not intended to be limited in its scope to this preferred environment with which it is described below.

Business forms delivery systems are generally designed to provide only either "face up" or "face down" delivery of business forms and to put a plurality of these forms in batches for subsequent use. Thus it is common for the industry to have both types of delivery systems available although the assignee of the present invention has also developed a delivery apparatus which is capable of either "face up" or "face down" delivery as is disclosed in our co-pending application (Ser. No. 174,461, filed Aug. 1, 1980).

Business forms come in a substantial variation of sizes which produces some difficulty in designing equipment to have a sufficient range of operating capability in receiving, inverting and batching the tremendous range of sizes of business forms currently in use. For example, business forms generally range in widths, i.e. the dimension in the direction of movement of the series of business forms through the device, of 3 2/5 inches to 17 inches, and sometimes even higher. In the past, when operating at various sizes within this range it has been necessary to change the creel assemblies in order to provide a different number of slots for receiving the business forms in the creels so that the appropriate operating speed can be maintained during batching of the business forms in conjunction with operation of a high-speed collator or press. The time required to change the creels is substantial and is therefore labor intensive as well as requiring substantial down time for the entire line of equipment while the modifications are being made.

SUMMARY OF THE INVENTION

The present invention overcomes the above described difficulties and disadvantages associated with the prior art devices by providing a creel assembly which is easily adjustable to provide a sufficient number of fingers for sorting the common ranges of business forms dimensions normally encountered.

The creel assembly of the present invention includes a pair of plates which are provided with an equal number of spirally formed fingers. A plurality of the creel assemblies are mounted on a common rotating shaft for receiving individual business forms in the slots formed between the fingers and depositing them in an inverted position on a conveyor for subsequent batching. The plates supporting the plurality of fingers are provided with means for permitting relative rotation of the plates and locking engagement so that the fingers of one plate can be positioned either in registry with the fingers of the associated plate or positioned so that twice the number of fingers are provided in equal spacing between the fingers of one plate and those of an associated plate.

DETAILED DESCRIPTION OF THE PREFERRED EMBODIMENT

Figure 4:
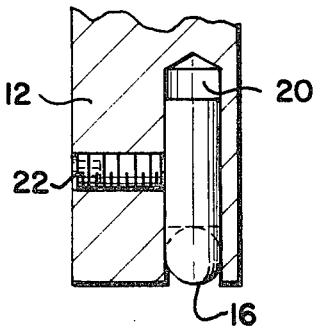
FIG. 4 is an enlarged partial cross sectional view in the direction of line 4—4 of FIG. 1, which illustrates the connection of the creel fingers to the creel finger support plates.

The creel assembly 10 of the present invention includes a pair of formed support plates 12 and 14 which each support a plurality of spirally formed fingers 16, with the preferred embodiment utilizing three fingers on each of the formed plates 12 and 14. In the preferred form, each of the fingers 16 is formed of rigid wire with the outer end portions 18 cut in an angle to assist in directing an individual business form between adjacent pairs of fingers 16. The innermost end of each of the fingers 16 is bent at a 90° angle and inserted in a corresponding hole 20, as shown in FIG. 4. Each of the fingers 16 is held in position by a retaining screw 22 threaded into the side of the plates 12 and 14 at the location of each of the holes 20. This construction permits ease of removal and replacement of damaged or bent fingers 16, if this becomes necessary.

Each of the plates 12 and 14 are provided with central openings 24 which can be aligned for mounting on a common support shaft 26 which is mounted in a delivery apparatus of the type such as that disclosed in the above referred to co-pending application (Ser. No. 174,461, filed Aug. 1, 1980) to which reference should be made for the details of construction of such a device. A locking screw 27 is provided in a correspondingly threaded hole in plate 12 extending into a slot 29 formed in the upper region of opening 24. A key (not shown) fits into slot 29 and a corresponding slot in shaft 26.

The fingers 16 are mounted to each support plate 12 and 14 so as to extend outwardly in their spiral pattern from the axis of rotation of shaft 26 and are positioned at equally angularly spaced intervals around the plates. The spiral formations of the fingers 16 extend outwardly in a direction opposite to the direction of rotation of the creel assemblies on the shaft 26.

Figure 1:
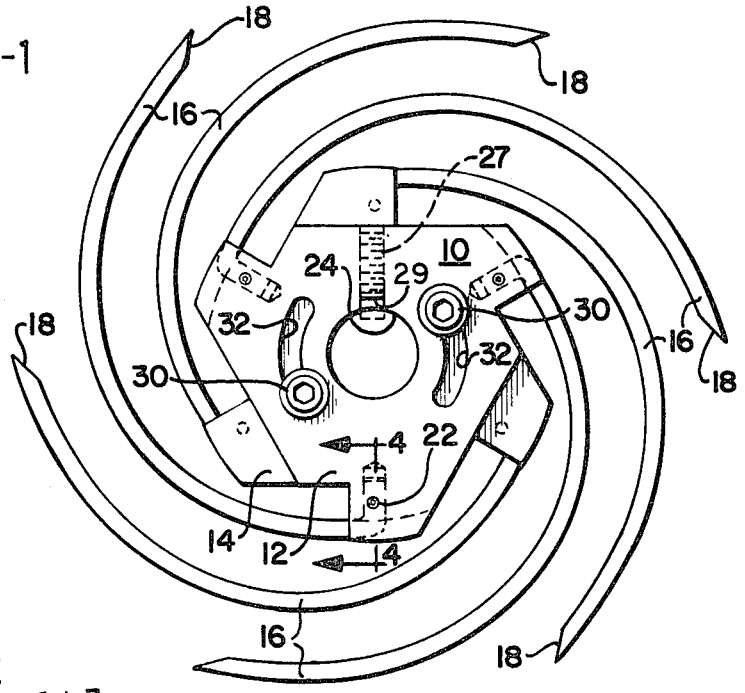
FIG. 1 is a detailed side view of the preferred embodiment of creel assembly of the present invention positioned to have the maximum number of fingers for receiving business forms.
Figure 2:
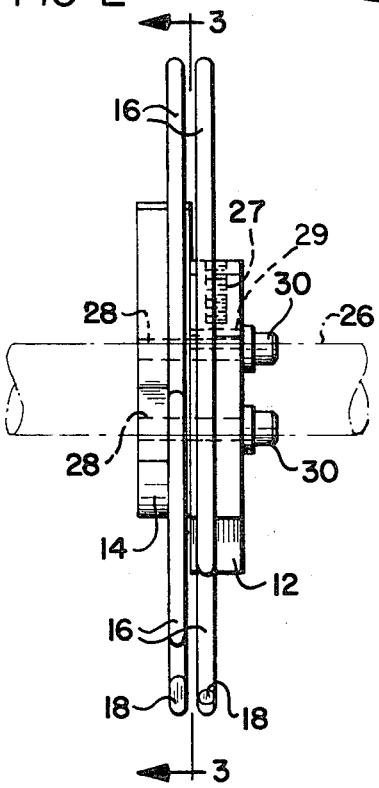
FIG. 2 is an end view of the assembly of FIG. 1 with the main support shaft for a plurality of the creels being shown in phantom.
Figure 3:
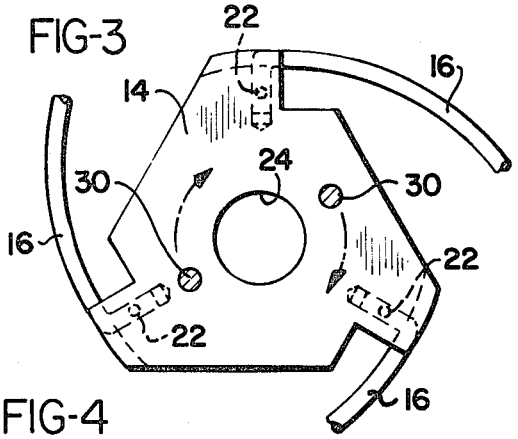
FIG. 3 is a partial sectional view along the line 3—3 of FIG. 2.
Figure 5:
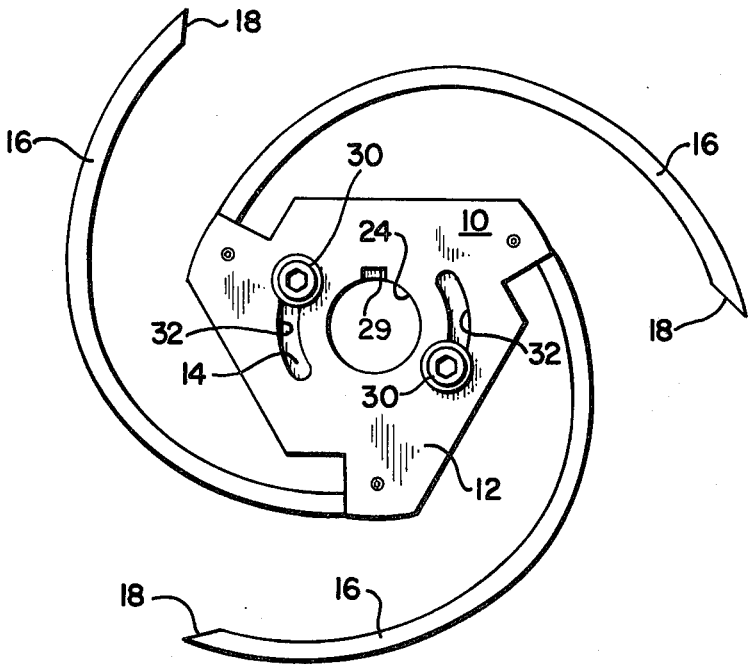
FIG. 5 is a side view of a creel assembly with the creel fingers phased to have the minimum number of fingers available for receiving business forms.

Plate 14 is provided with a pair of diametrally opposed threaded openings 28 which receive bolts 30. Bolts 30 extend through slots 32 defined in plate 12 and permit approximately 60° of relative movement between plates 12 and 14 in order to position the fingers either as shown in FIG. 1, with the fingers of plate 14 positioned intermediate the fingers of plate 12, or, as shown in FIG. 5, with the fingers of both plates in aligned or phased relationship so that only three fingers define slots for receiving business forms. Once the fingers are positioned in either of the positions of FIG. 1 or 5, the bolts 30 are tightened to hold the fingers in these relative positions.

The reason for this construction of the creel assemblies is that it has been discovered that a single creel construction having a predetermined number of fingers does not provide the optimum receiving capability for the wide range of business forms that are generally sorted by the industry. For example, business forms in the range of 3 2/5 inches to as high as 17 inches in length in the direction movement of business forms through a delivery apparatus, are needed to be sorted and the single form of creel of the prior art is generally not capable of efficiently receiving the diversity in length of business forms at the desired operating speeds of the equipment.

While the form of apparatus herein described constitutes a preferred embodiment of this invention, it is to be understood that the invention is not limited thereto, and that changes may be made therein without departing from the scope of the invention.

What is claimed is:

1. A creel for use in a business forms delivery apparatus, comprising:

a pair of plates;

means for mounting said plates together for rotation about a common central axis of symmetry;

a plurality of generally spirally formed fingers mounted at one end thereof to each of said plates so that both plates hold an equal number of said fingers at equally angularly spaced intervals and extending spirally outward from said axis counter to the direction of rotation of said plates;

said mounting means including means for limiting rotation of said plates relative to one another about said axis between a position wherein said spirally formed fingers on one of said plates are in registry with those on the other of said plates and a position in which said spirally formed fingers on said one plate are disposed equidistant between said spirally formed fingers on said other plate, said mounting means further including means for releasably holding said plates in either one of said positions.

2. A creel as defined in claim 1 wherein said spirally formed fingers are wires releasably secured to said plates.

3. A creel as defined in claim 1 wherein there are three spirally formed fingers secured to each said plate.

4. A creel as defined in claim 1 wherein said limiting means includes a pair of arcuate slots defined in one of said plates concentrically disposed with said axis and a pair of bolts threadably engaged in corresponding holes in the other of said plates and each extending through a corresponding slot, the length of said slots limiting relative rotation of said plates between said positions.

* * * * *